US005160200A

United States Patent [19]

Cheselske

[11] Patent Number: 5,160,200

[45] Date of Patent: Nov. 3, 1992

[54] WEDGE-BASE LED BULB HOUSING

[75] Inventor: David A. Cheselske, Upland, Calif.

[73] Assignee: R & D Molded Products, Inc., San Dimas, Calif.

[21] Appl. No.: 665,519

[22] Filed: Mar. 6, 1991

[51] Int. Cl.[5] ..... H01R 33/00

[52] U.S. Cl. ..... 362/249; 362/226; 362/800; 439/628

[58] Field of Search ..... 362/226, 227, 249, 800, 362/252, 253, 370, 441; 439/628

[56] References Cited

U.S. PATENT DOCUMENTS

| | | | |
|---|---|---|---|
| 4,445,164 | 4/1984 | Giles, III et al. | 362/800 |
| 4,575,785 | 3/1986 | Lerude et al. | 362/226 |
| 4,667,277 | 5/1987 | Hanchar | 362/252 |
| 4,761,720 | 8/1988 | Solow | 362/249 |
| 4,779,177 | 10/1988 | Ahroni | 362/249 |
| 4,897,769 | 1/1990 | Lang | 362/800 |
| 4,950,942 | 8/1990 | Braun et al. | 362/226 |
| 4,991,071 | 2/1991 | Braasch | 362/249 |
| 5,013,960 | 5/1991 | Tseng | 362/226 |
| 5,021,706 | 6/1991 | Chen | 362/226 |
| 5,039,832 | 8/1991 | Polacek et al. | 362/800 |

FOREIGN PATENT DOCUMENTS

| | | | |
|---|---|---|---|
| 1136797 | 12/1968 | United Kingdom | 439/628 |

*Primary Examiner*—Ira S. Lazarus
*Assistant Examiner*—Y. Quach
*Attorney, Agent, or Firm*—Christie, Parker & Hale

[57] ABSTRACT

An LED-based lamp has a hollow plastic cylindrical body with a closed end and an open end. A wedge-base extends from the closed end, and a pair of bores on opposite sides of the closed end through the closed end permit leads to pass from inside the cylindrical body to the outside of the base. A variety of different LED structures can be mounted within the hollow body to project light out the open end of the body.

9 Claims, 1 Drawing Sheet

WEDGE-BASE LED BULB HOUSING

FIELD OF THE INVENTION

The present invention pertains to the field of lamp construction and more particularly to a light emitting diode based substitute for wedge-base incandescent lamps.

BACKGROUND OF THE INVENTION

Much equipment currently uses wedge-base incandescent lamps of a type similar to that depicted in FIG. 1 The lamps are constructed from a single glass vacuum tube housing (a) which includes a wedge-base (b). A filament (c) within the lamp is connected to wire electrical leads (d) which extend out of the glass housing and are wrapped around the base. The base is simply wedged into a socket to install the lamp. Spring metal contact strips in the socket make an electrical connection with the wire leads and hold the lamp in place. Wedge-base incandescent lamps are often preferred because they are inexpensive to build and can be made in very small sizes. The main part of the housing which encloses the filament ranges in diameter from 2 or 3 millimeters to 2 to 3 centimeters, depending on the application. Such incandescent lamps have a limited useful life so that replacement is frequently required, have a limited range of operating temperatures, and are easily broken. Both the glass housing and the filament within are fragile. This short life span and fragility are particularly troublesome when the lamp is mounted in a difficult-to-access location. The cost of the labor to replace a lamp is often several orders of magnitude greater than the cost of the lamp.

SUMMARY OF THE INVENTION

The present invention provides a replacement using light emitting diodes (LEDs) for wedge-base incandescent lamps such as that shown in FIG. 1. The present invention has a much longer useful life and is far less prone to breakage in handling, in storage and in use. It can be used as a direct substitute and installed directly into a socket which is designed to hold a wedge-base incandescent lamp.

In one embodiment, the invention encompasses a wedge-base housing with a hollow plastic body extending along a central axis between a closed end and an opposite open end, the open end being adapted to receive and retain an LED structure. A plastic base integral with the body extends outward axially from the body closed end, the base having a central axial leg and two arms extending radially in opposite directions from the leg. A bore through the body closed end proximate each arm allows electrical leads extending from the LED structure to pass through the body closed end for electrical connection outside the body.

DETAILED DESCRIPTION OF THE DRAWINGS

These and other aspects of the invention will be more fully understood by referring to the following detailed description and the accompanying drawings wherein.

DETAILED DESCRIPTION OF THE INVENTION

Figure 1:
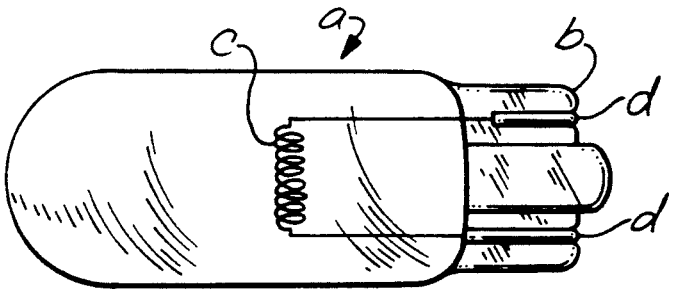
Fig. 1 PRIOR ART
FIG. 1 is a side elevation view of a prior art incandescent wedge-base lamp.
Figure 2A:
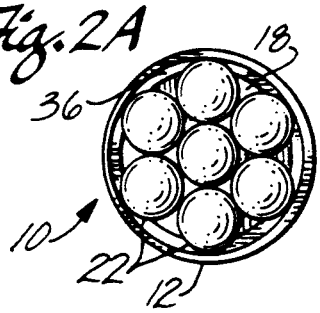
FIG. 2A is a top view of an LED based lamp according to the present invention.
Figure 2B:
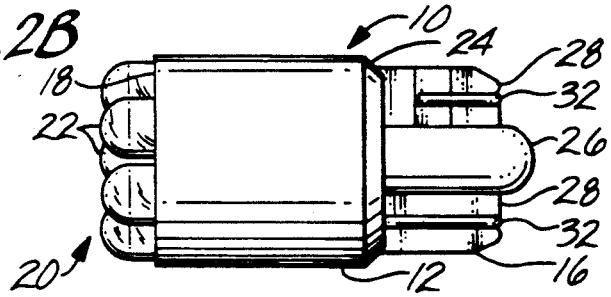
FIG. 2B is a side elevational view of the lamp of FIG. 2A.

The present invention allows a conventional incandescent wedge-base lamp to be replaced with a variety of different LED structures without any modification to the socket which holds the lamp. This is a significant advantage where the durability and long life of LEDs are desired. This is particularly important in extreme environments and in applications where the lamp will be very difficult or expensive to replace. A conventional incandescent wedge-base lamp is shown in FIG. 1. LEDs can also be used for greater brightness than could be obtained with incandescent lamps of the same size. FIGS. 2A and 2B show an LED based lamp embodying the present invention, the lamp has a housing 10 which is constructed from a cylindrical main body 12 and a base 16. The body and the base are preferably molded from a single piece of plastic currently acetal is preferred, although nylon or any sufficiently electrically insulating and flame and heat retardant material may be used. The cylindrical body has an open end 18 into which an LED structure 20 made up of a plurality of LEDs 22 is inserted. Opposite the open end is a closed end 24. The base extends from this closed end.

Figure 5:
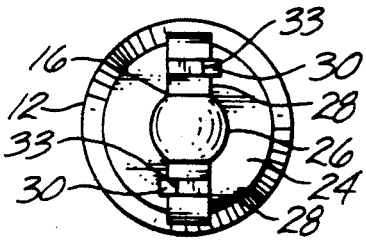
FIG. 5 is a bottom view of the plastic housing of the lamp of FIG. 2A with the LEDs removed.

The base has a central leg 26 extending along the cylindrical axis of the body, and an arm 28 extending radially from two opposite sides of the central leg in opposite directions. As shown in FIG. 5, the closed end of the body has a pair of bores 30 through which electrical leads 32 of the leads extend. This allows the LEDs to extend through the housing and wrap around their respective opposite radial arms for electrical connection in a lamp socket. Each arm has an axial groove 33 for receiving the electrical leads and holding them in place on the base. The base structure mimics that used on the prior art lamp of FIG. 1 so that the lamp can be inserted into a socket which is designed to receive an incandescent lamp. The grooves 33 substantially improve upon the conventional base structure by more reliably locating the electrical leads.

Figure 3:
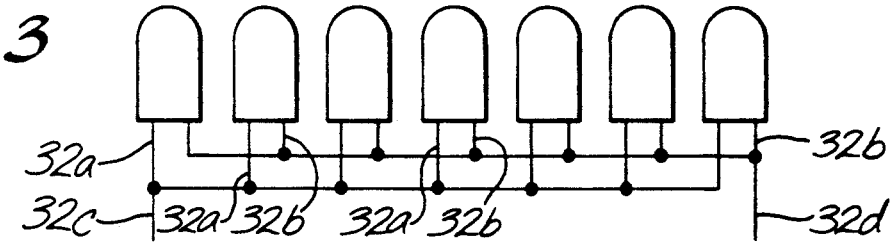
FIG. 3 is a side view of a linear string of LEDs with connected leads to form an LED structure for use with the present invention.
Figure 4:
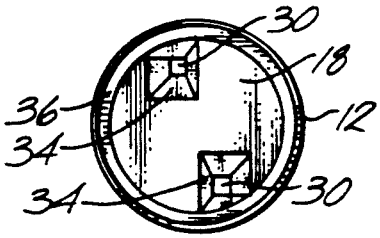
FIG. 4 is a top view of the plastic housing of the lamp of FIG. 2A with the LEDs removed.

The housing 10 can be used with a variety of different LED structures. A single large LED or a combination of smaller LEDs can be used. The voltage current and output characteristics of the LEDs including color, brightness and frequency can be varied to suit different applications. It is presently preferred that a group of LEDs be electrically linked to form a single LED structure and inserted as a group into the housing 10. As shown in FIG. 3, each such LED has a pair of electrical leads **32*a* and 32*b*. In order to form a cylindrical structure preferred for mounting within the cylindrical body, the LEDs are first arranged in a single line as shown in FIG. 3. The leads of a first polarity 32*a* are then coupled together and coupled to a lead of that polarity 32*c* at one end of the string. Then the leads of the other polarity 32*b* are connected together and to a lead at the opposite end of the string 32*d* forming a serial string of LEDs having one pair of common leads 32*c* and 32*d* which extend away from the LEDs. This serial string is rolled bending the leads to form the cylindrical roll of LEDs of the LED structure 20 shown in FIG. 2***a*.

The LED structure is inserted into the housing 10 by inserting the electrical leads 32*c*, 32*d* into the open end of the housing 10, and then inserting one of the leads into each of the bores 30 in the closed end of the body. A funnel-shaped guide 34, surrounding the opening of the bores in the closed end of the body, help to guide the electrical leads into the bores. Since the bores are located adjacent the radial arms of the base, as shown in FIG. 5, the leads extend through the bores alongside the radial arms. The leads are then wrapped around the ends of the radial arms to hold the LEDs in place in the housing. The LED structure can be held in place by the bent wire leads alone or a variety of adhesives or interlocking constructions can be used to lock the LED structure into place. The body has a flange 36 just below the open end which serves as a contact point for the bottoms of the LEDs. The LEDs are pushed into the body until they rest against the flange as best shown in FIG. 2A. Bending the wires holds the LEDs against the flange.

While only a single embodiment has been described above, a variety of modifications and adaptations can be made without departing from the spirit and scope of the present invention. The particular proportions and the dimensions of the housing can be varied. A great variety of LED structures different from that shown in the drawings may be used to suit particular applications. A reflector may be inserted into the body between the closed end of the body and the LEDs to reflect light outward from the body. A variety of lenses can be used over the LEDS to disperse or focus light in any particular direction. Protective covers can be used to cover the LEDs and housing. The body can be constructed in a variety of noncylindrical shapes, and the specific material from which the housing is constructed can be varied to suit specific applications. Electrical conducting plates connected to the electrical leads can be fastened to the arms of the wedge-base in lieu of using the electrical leads for directly connecting to the conductors in the lamp socket. It is not intended to limit the scope of the invention to the depicted embodiments, but only by the claims appended hereto.

What is claimed is:

1. A wedge-base housing for substituting an LED structure for an incandescent wedge-base lamp comprising:

a hollow plastic body extending along a central axis between a closed end and an opposite open end, the open end being adapted to receive and retain an LED structure;

a plastic base integral with the hollow plastic body and extending outward axially from the hollow plastic body closed end, the plastic base having a central axial leg and two arms extending radially in opposite directions from the central axial leg, each arm having an axial end remote from the hollow plastic body; and a bore through the hollow plastic body closed end proximate each arm for allowing electrical leads extending from the LED structure to pass through the hollow plastic body closed end for electrical connection outside the hollow plastic body, wherein the wedge-base housing further comprises a groove in each arm extending axially from a location proximate the bore and around the axial end of each arm for receiving an LED electrical lead.

2. The wedge-base housing of claim 1 further comprising a funnel-shaped guide in the hollow plastic body interior for each bore to guide the electrical leads into the bores.

3. The wedge-base housing of claim 1 wherein the hollow plastic body is cylindrical.

4. An LED-based lamp for substitution for a wedge-base incandescent lamp comprising:

a hollow plastic body extending along a central axis between a closed end and an opposite open end;

a plastic base integral with the hollow plastic body and extending outward axially from the hollow plastic body closed end, the plastic base having a central axial leg and two arms extending radially in opposite directions from the central axial leg, each arm having an axial end remote from the hollow plastic body;

an LED structure within the hollow plastic body and extending from the hollow plastic body open end, the hollow plastic body having at least two electrical leads; and a bore through the hollow plastic body closed end proximate each arm for allowing the electrical leads from the LED structure to pass through the hollow plastic body closed end for electrical connection outside the hollow plastic body, wherein the LED-based lamp further comprises a groove in each arm extending axially from a location proximate the bore and around the axial end of each arm for receiving an LED electrical lead.

5. The LED-based of claim 4 further comprising a funnel-shaped guide in the hollow plastic body interior for each bore to guide the electrical leads into the bores.

6. The LED-based lamp of claim 4 wherein the hollow plastic body is cylindrical.

7. The LED-based lamp of claim 4 wherein the LED structure comprises a plurality of LEDs.

8. The lamp of claim 7 wherein each LED has two leads, and wherein the leads of each LED are connected to all other LED leads of like polarity.

9. A method of constructing an LED-based lamp for substitution for a wedge-base incandescent lamp comprising:

molding from plastic a hollow cylindrical body extending along a central axis between a closed end and an opposite open end, the open end being adapted to receive and retain an LED structure and a base integral with the hollow cylindrical body and extending outward axially from the body closed end, the base having a central axial leg and two arms extending radially in opposite directions from the central axial leg;

connecting together electrical leads of like polarity from a plurality LEDs to form a linear string of interconnected LEDs with two common extending leads;

rolling the linear string of LEDs to form a substantially cylindrical cylindrical roll with two electrical leads extending substantially parallely from the roll;

inserting the two electrical leads into the hollow cylindrical body open end and through bores in the body hollow cylindrical body closed end to pass through the hollow cylindrical body closed end proximate the arms of the base;

inserting the LED cylindrical into the hollow cylindrical body open end; and fastening the LED roll into place in the hollow cylindrical body.

* * * * *

UNITED STATES PATENT AND TRADEMARK OFFICE

CERTIFICATE OF CORRECTION

PATENT NO. : 5,160,200

DATED : November 3, 1992

INVENTOR(S) : David A. Chelselske

It is certified that error appears in the above-identified patent and that said Letters Patent is hereby corrected as shown below:

Column 1, line 14, after "1" insert a period.

Column 4, line 30, after "LED-based" insert -- lamp --.
Column 4, line 52, after "plurality" insert -- of --.
Column 4, line 56, delete "cylindrical" (second occurrence).

Signed and Sealed this

Ninth Day of November, 1993

Bruce Lehman

*Attest:*

BRUCE LEHMAN

*Attesting Officer*

*Commissioner of Patents and Trademarks*